US005218642A

United States Patent [19]

Chin-Fa

[11] Patent Number: 5,218,642

[45] Date of Patent: Jun. 8, 1993

[54] FEEDBACK NOISE-ELIMINATING MICROPHONE CIRCUIT

[76] Inventor: Yen Chin-Fa, 5F, No. 10, Lane 560, Chung Cheng Rd., Hsinten, Taipei Hsien, Taiwan

[21] Appl. No.: 783,771

[22] Filed: Oct. 29, 1991

[51] Int. Cl.[5] ..... H04R 27/00

[52] U.S. Cl. ..... 381/83; 381/92; 381/93; 381/95

[58] Field of Search ..... 381/93, 95, 92, 83, 381/94, 57, 108

[56] References Cited

U.S. PATENT DOCUMENTS 5,033,090 7/1991 Weinrich ..... 381/93

5,077,800 12/1991 Dupret et al. ..... 381/68.4

*Primary Examiner*—Forester W. Isen

*Attorney, Agent, or Firm*—Morton J. Rosenberg; David I. Klein

[57] ABSTRACT

A feed-back noise-eliminating microphone circuit is provided. The circuit includes a positive-phase pick-up circuit to pick up sound source signal for amplification through a positive-phase amplifier for further output through a balance adjusting circuit and a power amplifier. The circuit further includes a reverse-phase pick-up circuit to pick up feedback signals from the loudspeaker for amplification through a reverse-phase amplifier, wherein feedback noise from the reverse-phase amplifier is offset at said balance adjusting circuit by the output signal from the positive-phase amplifier.

1 Claim, 2 Drawing Sheets

FEEDBACK NOISE-ELIMINATING MICROPHONE CIRCUIT

BACKGROUND OF THE INVENTION

The present invention is related to a microphone circuit and relates more particularly to a feedback noise-eliminating microphone circuit which eliminates noises by means of the operation of positive-phase and reverse-phase pick-up circuits, positive-phase and reverse-phase amplifiers, and a balance adjusting circuit.

A microphone circuit according the prior art technique is generally comprised of a pick up circuit to pick up a sound source, an amplifier to amplify the signal detected by the pick up circuit, and a loudspeaker for the output therethrough of the signal amplified by the amplifier. The common disadvantage in regular microphone circuits is that a whistling noise tends to occur during operation. The whistling noise is produced due to feedback noise from the loudspeaker. When the volume is increased, the feedback noise will be increase too. A phasing circuit may be used to improve this problem, however, it still can not provide a satisfactory result.

SUMMARY OF THE INVENTION

The present invention overcomes the aforesaid problem by providing a microphone circuit which can effectively eliminate any feedback noise. According to the present invention, a feed-back noise-eliminating microphone circuit is generally comprised of a positive-phase pick-up circuit which picks a sound source signal for amplification through a positive-phase amplifier for further output through a balance adjusting circuit and a power amplifier, and a reverse-phase pick-up circuit which picks up feedback signal from the loudspeaker for amplification through a reverse-phase amplifier, wherein feedback noise from said reverse-phase amplifier is offset at said balance adjusting circuit by the output signal from said positive-phase amplifier.

DETAILED DESCRIPTION OF THE PREFERRED EMBODIMENT

Figure 1:
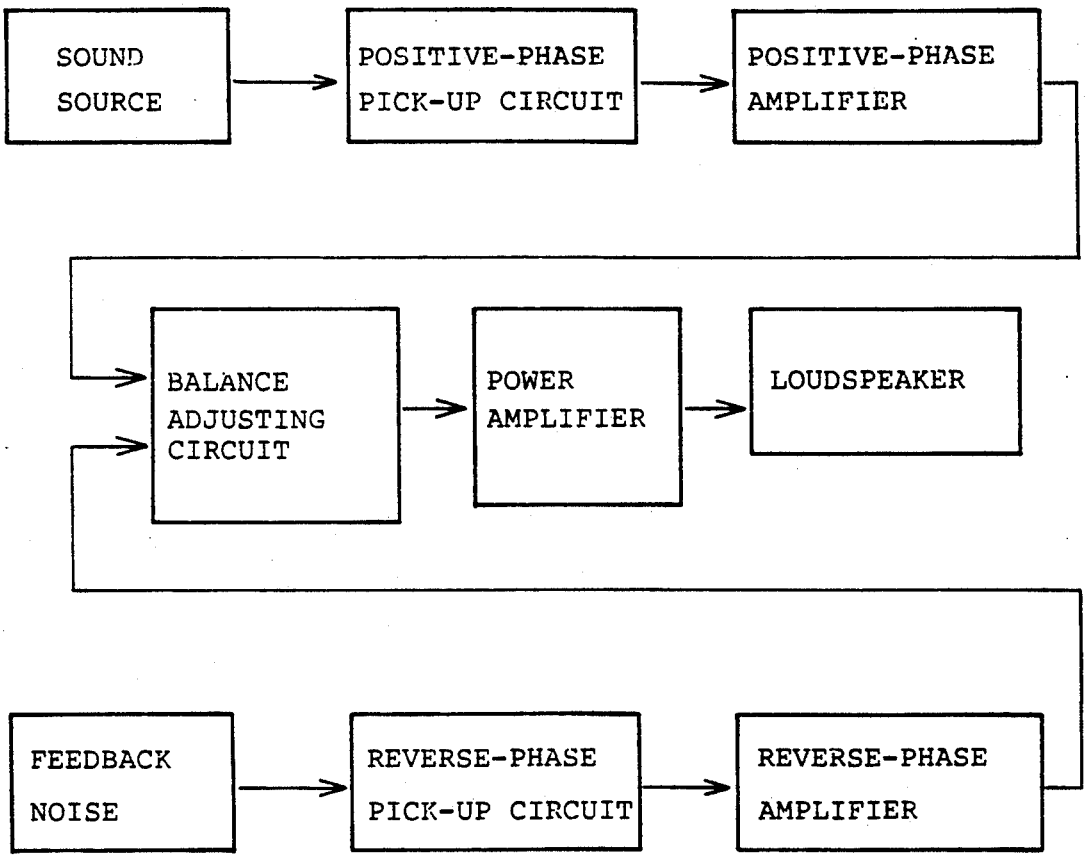
FIG. 1 is a block diagram showing the structure of the present invention.

Referring to FIG. 1, a feedback noise-eliminating microphone circuit as constructed in accordance with the present invention is generally comprised of a positive-phase pick-up circuit 11, a positive-phase amplifier 12, a reverse-phase pick-up circuit 21, a reverse-phase amplifier 22, a balance adjusting circuit 3, a power amplifier 4 and a loudspeaker 5. The sound source 1 which is detected by the positive-phase detecting circuit 11 is amplified by the positive-phase amplifier 12 and sent to the power amplifier 4 for amplification via the balance adjusting circuit 3 and then, for further output through the loudspeaker 5. At the same time, the feedback noise 2 which is detected by the reverse-phase pick-up circuit 21 is amplified by the reverse-phase amplifier 22 and sent to the balance adjusting circuit 3 to offset the phase of the signal from the output terminal of the positive-phase amplifier 12. The balance adjusting circuit 3 has a bias in favor of the output signal from the positive-phase amplifier, less the amount of the output signal from the reverse-phase amplifier, by which it is offset. When a whistling noise is produced, the output from the negative-phase amplifier 22 will be abruptly increased to offset. When the output from the reverse-phase amplifier 22 is increased, the offset process at the balance adjusting circuit 3 is respectively increased, and therefore, whistling noise can be completely eliminated before its formation at the loudspeaker and a higher volume of sound, with better quality can be produced through the loudspeaker.

Figure 2:
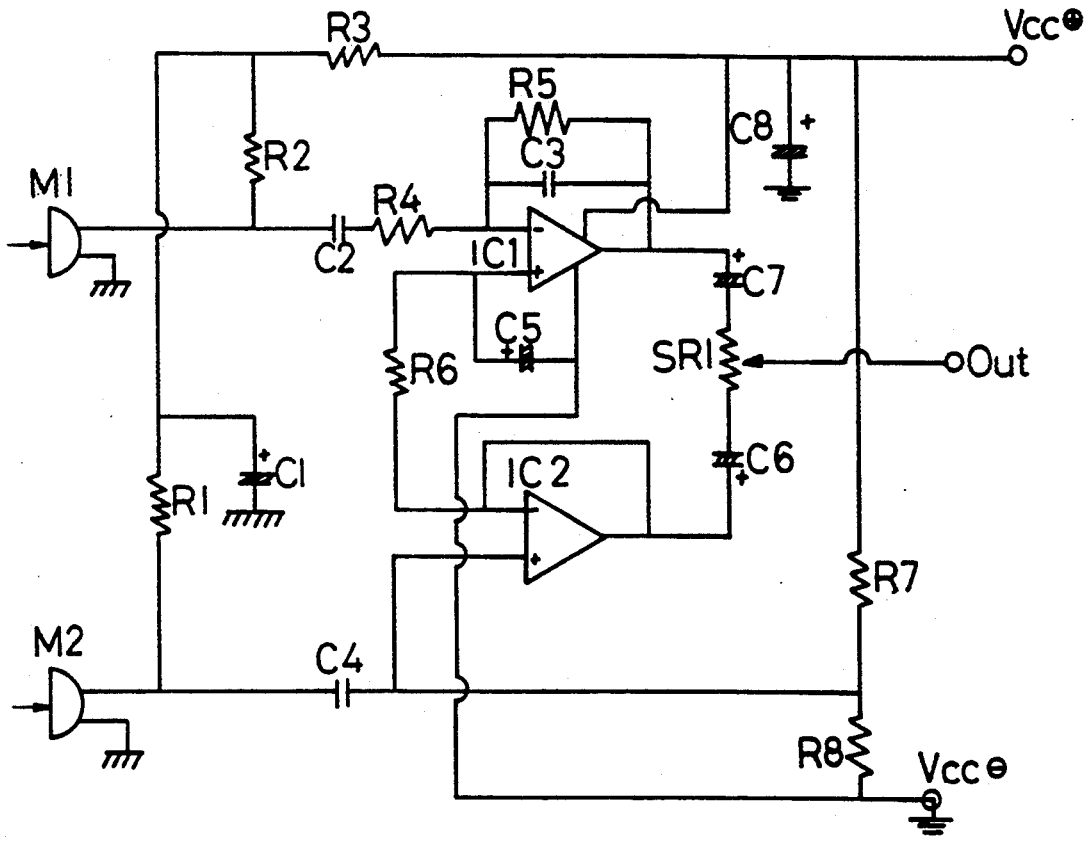
FIG. 2 is a circuit diagram of the preferred embodiment of the feedback noise-eliminating microphone circuit of the present invention.

Referring to FIG. 2, a first microphone (M1) picks up the signal from a sound source and sends it to a positive-phase amplifier which consists of an integrated circuit amplifier (IC1), a plurality of resistors (R2), (R3), (R4), (R5) and a plurality of capacitors (C1), (C2), (C3), (C5), (C7), for amplification. Second microphone (M2) picks up the feedback signal from a loudspeaker and sends it to a reverse-phase amplifier which consists of an integrated circuit amplifier (IC2), a plurality of resistors (R1), (R6), (R7), (R8), and a plurality of capacitors (C4), (C6), for amplification. The output terminals of the positive-phase amplifier and the negative phase amplifier are respectively connected to the two opposite ends of a variable resistor (SR1) from which a balanced output signal is obtained and sent to a power amplifier for driving a loudspeaker connected thereto, to produce a sound. Because the variable resistor (SR1) biases the output terminal of the positive-phase amplifier, any whistling noise will be inhibited immediately after amplification through the reverse-phase amplifier. Therefore, no whistling noise will be produced when the loudspeaker is driven to produce a sound of high volume.

What is claimed is:

1. A feedback noise-eliminating microphone circuit for coupling to an amplifier driven loudspeaker, comprising:

a first microphone for generating a first signal responsive to receiving a signal from an acoustic source and a feedback signal from said loudspeaker;

a positive-phase amplifier having an input coupled to an output of said first microphone for pre-amplifying said first signal, wherein said positive-phase amplifier generates a first output signal having a first predetermined phase relationship with respect to said first signal;

a second microphone disposed in a predetermined position for generating a second signal responsive to receiving a feedback signal from said loudspeaker;

a reverse-phase amplifier having a non-inverting input coupled to an output of said second microphone for pre-amplifying said output signal, wherein said reverse-phase amplifier generates a second output signal having a second predetermined phase relationship with respect to said second signal, said predetermined phase relationship of said second output signal being opposite said predetermined phase relationship of said first output signal;

balance adjustment means coupled to respective outputs of both said positive-phase amplifier and said reverse phase amplifier for generating a third output signal from said first and second output signals, said balance adjustment means including a potentiometer having (1) one end coupled to said positive-phase amplifier for receiving said first output signal, (2) an opposing end coupled to said reverse-phase amplifier for receiving said second output signal, and (3) a variably positionable tap for coupling said third output signal to a driver amplifier, whereby said third output signal is defined by a signal representing said acoustic signal substantially devoid of said feedback signal.

* * * * *